US009742089B2

(12) United States Patent
Ebisawa et al.

(10) Patent No.: US 9,742,089 B2
(45) Date of Patent: Aug. 22, 2017

(54) METAL TERMINALS

(71) Applicant: Molex, LLC, Lisle, IL (US)

(72) Inventors: Satoshi Ebisawa, Yamato (JP); Toshihiro Niitsu, Machida (JP); Hitomi Inukai, Yamato (JP)

(73) Assignee: Molex, LLC, Lisle, IL (US)

( * ) Notice: Subject to any disclaimer, the term of this patent is extended or adjusted under 35 U.S.C. 154(b) by 0 days.

(21) Appl. No.: 15/110,911

(22) PCT Filed: Feb. 3, 2015

(86) PCT No.: PCT/US2015/014168
§ 371 (c)(1),
(2) Date: Jul. 11, 2016

(87) PCT Pub. No.: WO2015/117109
PCT Pub. Date: Aug. 6, 2015

(65) Prior Publication Data

US 2016/0336671 A1 Nov. 17, 2016

(30) Foreign Application Priority Data

Feb. 3, 2014 (JP) ..... 2014-018312

(51) Int. Cl.

| | |
|---|---|
| ***H01R 13/20*** | (2006.01) |
| ***H01R 12/73*** | (2011.01) |
| ***H01R 12/75*** | (2011.01) |
| ***H01R 12/70*** | (2011.01) |

(52) U.S. Cl.
CPC ..... *H01R 13/20* (2013.01); *H01R 12/707* (2013.01); *H01R 12/732* (2013.01); *H01R 12/75* (2013.01)

(58) Field of Classification Search
CPC .... H01R 13/20; H01R 12/707; H01R 12/732; H01R 12/75
See application file for complete search history.

(56) References Cited

U.S. PATENT DOCUMENTS 4,552,425 A * 11/1985 Billman ..... H01R 13/113 439/295
5,385,491 A * 1/1995 Fry ..... H01R 13/4368 439/595
5,989,078 A * 11/1999 Chaillot ..... H01R 43/16 439/851

(Continued)

FOREIGN PATENT DOCUMENTS

| | | |
|---|---|---|
| JP | 57-84580 A | 5/1982 |
| JP | 59-177188 U | 11/1984 |
| KR | 10-1337546 B1 | 12/2013 |

*Primary Examiner* — Alexander Gilman
(74) *Attorney, Agent, or Firm* — James A. O'Malley

(57) ABSTRACT

The metal terminals are a first terminal, and a second terminal mated with the first terminal, the first terminal has a first main body portion, a first contact portion, and a first lock portion, the second terminal has a second main body portion, a second contact portion contacting the first contact portion, and a second lock portion locking the first lock portion. The first lock portion includes a first engaging portion arranged on a surface of the first main body portion, and the second lock portion including a pair of second engaging portions arranged on opposing surfaces of the second main body portions.

20 Claims, 12 Drawing Sheets

(56) References Cited

U.S. PATENT DOCUMENTS

| | | | | |
|---|---|---|---|---|
| 6,179,660 | B1 * | 1/2001 | Salaguinto | H01R 13/424<br>439/585 |
| 7,329,158 | B1 * | 2/2008 | Roberts | H01R 13/115<br>439/825 |
| 9,160,089 | B2 * | 10/2015 | Shimoji | H01R 12/7082 |
| 9,306,301 | B2 * | 4/2016 | Shimoji | H01R 12/53 |
| 9,331,408 | B2 * | 5/2016 | Ono | H01R 12/728 |
| 2008/0305668 | A1 * | 12/2008 | Wu | H01R 13/20<br>439/272 |
| 2013/0303037 | A1 * | 11/2013 | Shimoji | H01R 12/728<br>439/854 |

* cited by examiner

METAL TERMINALS

REFERENCE TO RELATED APPLICATIONS

The Present Disclosure claims priority to prior-filed Japanese Patent Application No. 2014-018312, entitled "Metal Terminals," filed on 3 Feb. 2014 with the Japanese Patent Office. The content of the aforementioned patent application is incorporated in its entirety herein.

BACKGROUND OF THE PRESENT DISCLOSURE

The Present Disclosure relates, generally, to metal terminals, and, more particularly Various conventional connecting devices that are currently used have male and female connectors for connecting an electrical wire such as a cable to an electrical device or an electronic device. A technique has been proposed for inverting the orientations of male connectors and female connectors able to engage each other when the arrangement of terminals changes. An example is disclosed in Japanese Patent Application No. 57-084580, the content of which is incorporated in its entirety herein.

FIGS. 12A and 12B are diagrams showing a conventional connecting device. FIG. 12A is a perspective view of the female connector, and FIG. 12B is a front view of the female connector. In these figures, 811 is the housing of the female connector. The housing is made of an insulating material, and has a recessed portion 812 for receiving and engaging an inserted male connector (not shown). The female connector is connected to the end of an electrical cord 891.

The recessed portion 812 has a rectangular cross-sectional profile, and has an upper flat surface 812*a* and a lower flat surface 812*b* opposing each other and extending in the transverse direction. A female grounding terminal 851*a*, a female first signal terminal 851*b*, and a female second signal terminal 851*c* are arranged in sequential order from the left in FIG. 12B on the upper flat surface 812*a*. A female grounding terminal 851*a*, a female first signal terminal 851*b*, and a female second signal terminal 851*c*are also arranged in sequential order from the right in FIG. 12B on the lower flat surface 812*b*. The male grounding terminals, male first signal terminals, and male second signal terminals arranged on the upper flat surface and lower flat surface of the rectangular tongue portion in the housing of the male connector (not shown) are arranged so as to correspond to these female grounding terminals 851*a*, female first signal terminals 851*b*, and female second signal terminals 851*c*.

As shown in FIG. 12B, the arrangement of the female grounding terminals 851*a*, female first signal terminals 851*b*, and female second signal terminals 851*c* on the upper flat surface 812*a* and the lower flat surface 812*b* are point symmetrical relative to the center point of the recessed portion 812 when viewed from the front. The male grounding terminals, male first signal terminals, and male second signal terminals of the male connector (not shown) are also point symmetrical relative to the center point of the recessed portion 812. As a result, the male connector and female connector are mated with each other even when the vertical orientation of the female connector or the male connector has been inverted.

However, in such connecting devices, the female connector has a housing 811 which has larger outer dimensions than the female grounding terminals 851*a*, female first signal terminals 851*b*, and female second signal terminals 851*c*. The male connector (not shown) also has a housing which has larger outer dimensions than the male grounding terminals, male first signal terminals, and male second signal terminals. As electrical devices and electronic devices become smaller, the space available to arrange the connecting device shrinks. However, a space larger than the female terminals and male terminals themselves is still required when female connectors and male connectors are used.

SUMMARY OF THE PRESENT DISCLOSURE

In order to solve the aforementioned problems, the object of the Present Disclosure is to provide metal terminals in which a pair of metal terminals having inverted profiles relative to each other but able to be mated with each other can be mounted directly onto conductive components, so that the connecting operation can be performed easily in a short period of time, the required mounting space can be reduced, the structure can be simplified and costs can be reduced, and the number of applications can be increased. In order to achieve this purpose, the Present Disclosure is metal terminals having a first terminal made of a conductive metal, and a second terminal made of a conductive metal and mated with the first terminal; the first terminal having a first main body portion, a first fixed portion fixed to a connecting portion of a first conductive component, a first contact portion, and a first lock portion; the second terminal having a second main body portion, a second fixed portion fixed to a connecting portion of a second conductive component, a second contact portion contacting the first contact portion, and a second lock portion; the first lock portion including a first engaging portion arranged on a surface of the first main body portion; and the second lock portion including a pair of second engaging portions arranged on opposing surfaces of the second main body portion.

In other metal terminals of the Present Disclosure, the first contact portion and the first lock portion are arranged in the mating direction, and the second contact portion and the second lock portion are arranged in the mating direction. In other metal terminals of the Present Disclosure, the second engaging portions are each arranged at point symmetrical positions when viewed from the mating direction. In other metal terminals of the Present Disclosure, the second contact portion includes a pair of second contact arm portions arranged on opposing surfaces of the second main body portion so as to elastically clamp the first contact portion.

In other metal terminals of the Present Disclosure, the second contact arm portions are each arranged at point symmetrical positions when viewed from the mating direction. In other metal terminals of the Present Disclosure, the first fixed portion is connected electrically and mechanically to a connecting portion of the first conductive component, the first terminal is mounted directly on the first conductive component, the second fixed portion connected electrically and mechanically to a connecting portion of the second conductive component, and the second terminal is mounted directly on the second conductive component. In other metal terminals of the Present Disclosure, the first conductive component is a board or an electrical wire, and the second conductive component is a board or an electrical wire.

The Present Disclosure is able to provide metal terminals in which a pair of metal terminals having inverted profiles relative to each other but able to be mated with each other can be mounted directly onto conductive components, so that the connecting operation can be performed easily in a short period of time, the required mounting space can be reduced, the structure can be simplified and costs can be reduced, and the number of applications can be increased.

BRIEF DESCRIPTION OF THE FIGURES

The organization and manner of the structure and operation of the Present Disclosure, together with further objects and advantages thereof, may best be understood by reference to the following Detailed Description, taken in connection with the accompanying Figures, wherein like reference numerals identify like elements, and in which:

FIGS. 1A and 1B are a pair of perspective views according to a first embodiment of the Present Disclosure, in which the first terminal is mounted on a board and the second terminal is mounted on an electrical wire, in which FIG. 1A is the view before engagement and FIG. 1B is the view after engagement;

FIGS. 3A-3E are a set of five views of the first terminal of FIGS. 1A and 1B, in which FIG. 3A is a top view, FIG. 3B is a side view, FIG. 3C is a bottom view, FIG. 3D is a front view and FIG. 3E is a rear view;

FIGS. 5A-5E are a set of five views of the second terminal of FIG. 4, in which FIG. 5A is a top view, FIG. 5B is a side view, FIG. 5C is a bottom view, FIG. 5D is a front view and FIG. 5E is a rear view;

FIGS. 7A and 7B are a pair of perspective views of the first embodiment of the Present Disclosure, in which the first terminal is mounted on a board and the second terminal is mounted on an electrical wire in a vertically inverted orientation, in which FIG. 7A is the view before engagement and FIG. 7B is the view after engagement;

8A and 8B are a pair of perspective views of a second embodiment of the Present Disclosure, in which first and second terminals are mounted on a board, in which

FIGS. 10A-10E are a set of five views of the second terminal of FIGS. 8A and 8B, in which FIG. 10A is a top view, FIG. 10B is a side view, FIG. 10C is a bottom view, FIG. 10D is a front view and FIG. 10E is a rear view;

FIGS. 12A and 12B are diagrams showing a conventional connecting device, in which FIG. 12A is a perspective view of the female connector and FIG. 12B is a front view of the female connector.

DESCRIPTION OF THE PREFERRED EMBODIMENTS

While the Present Disclosure may be susceptible to embodiment in different forms, there is shown in the Figures, and will be described herein in detail, specific embodiments, with the understanding that the Present Disclosure is to be considered an exemplification of the principles of the Present Disclosure, and is not intended to limit the Present Disclosure to that as illustrated.

As such, references to a feature or aspect are intended to describe a feature or aspect of an example of the Present Disclosure, not to imply that every embodiment thereof must have the described feature or aspect. Furthermore, it should be noted that the description illustrates a number of features. While certain features have been combined together to illustrate potential system designs, those features may also be used in other combinations not expressly disclosed. Thus, the depicted combinations are not intended to be limiting, unless otherwise noted.

In the embodiments illustrated in the Figures, representations of directions such as up, down, left, right, front and rear, used for explaining the structure and movement of the various elements of the Present Disclosure, are not absolute, but relative. These representations are appropriate when the elements are in the position shown in the Figures. If the description of the position of the elements changes, however, these representations are to be changed accordingly.

Figure 1A:
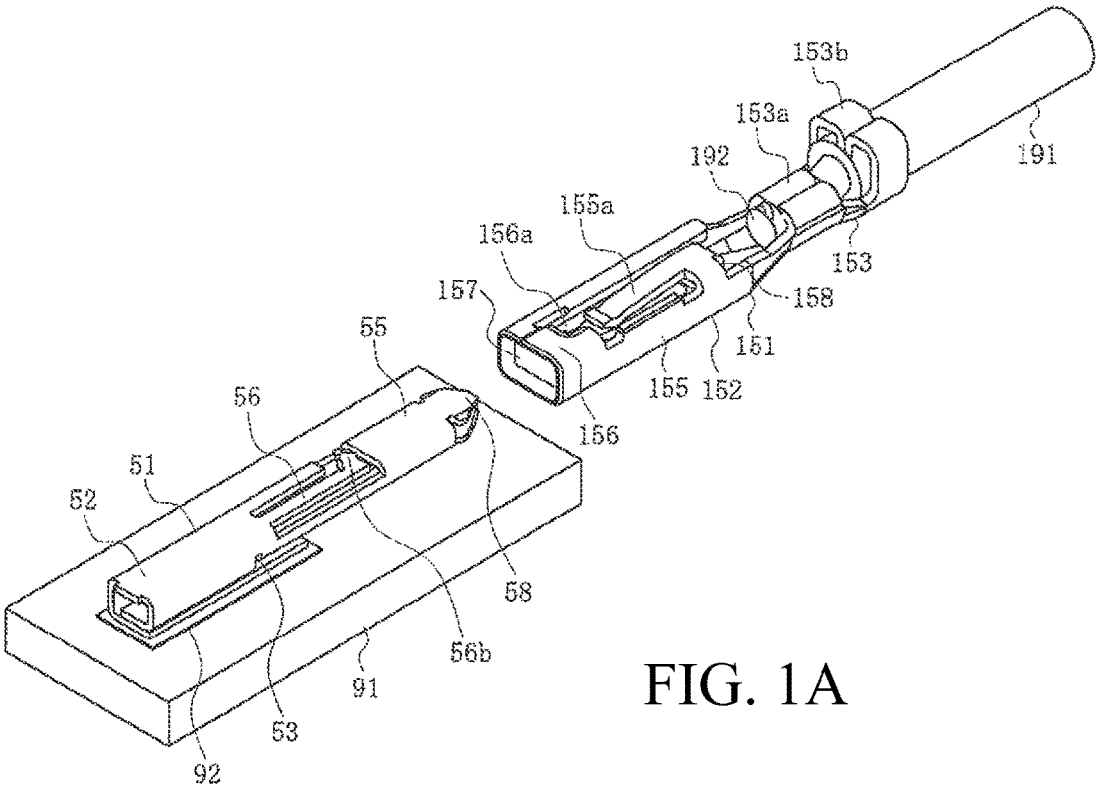
Figure 1B:
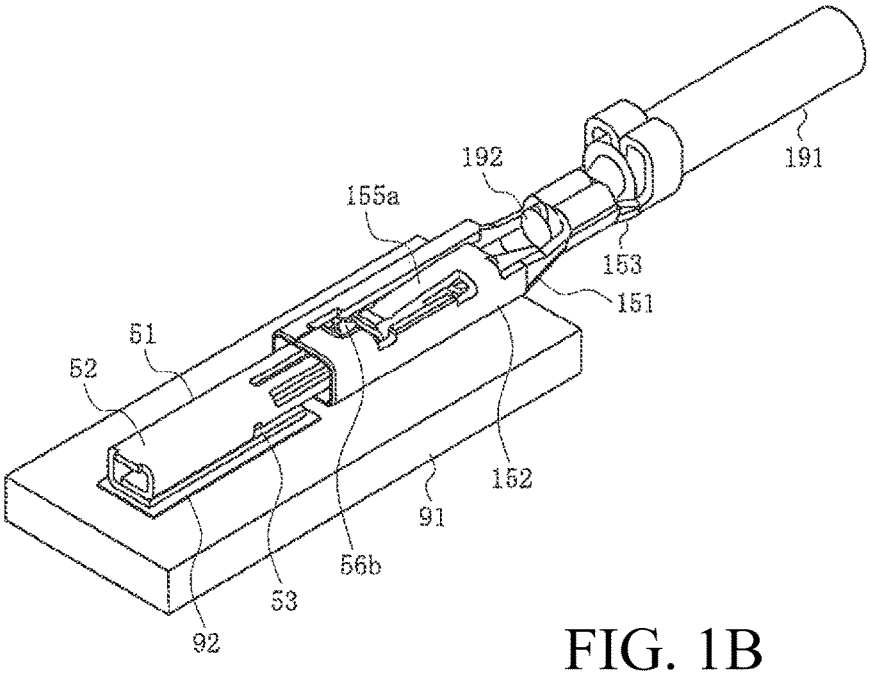

FIGS. 1A-3E illustrate a first embodiment of the Present Disclosure. In these Figures, 51 is the first terminal of a pair of terminals in the present embodiment, and 151 is the second terminal of the pair of terminals in the present embodiment. The metal terminals in the present embodiment, as shown in FIGS. 1A and 1B, are used to electrically and mechanically connect a board 91 serving as a first conductive component to an electrical wire 191 serving as the second conductive component. However, these metal terminals may be used to electrically and mechanically connect the board 91 to another board 195, or to electrically and mechanically connect the electrical wire 191 to another electrical wire.

Boards 91 and 195 may be printed circuit boards or flexible circuit boards used in electrical devices and electronic device such as personal computers, mobile phones, smartphones, digital televisions, car navigation systems or gaming systems. They can also be semiconductor circuit boards on which light-receiving elements and light-emitting elements have been mounted which are used in solar panels, liquid crystal displays, light emitting diode (LED) display devices and LED lighting devices. The electrical wire 191 can also be any type of wire used in any type of device. In other words, the first and second conductive components can be any type of conductive component. The metal terminals in the present embodiment can be also be used to connect power lines, connect ground lines, or connect signal lines.

The first terminal 51 is an integrated component created by stamping and bending a conductive metal sheet, and has a first main body portion 52, a first fixed portion 53 connected below the first main body portion 52, a first contact portion 55 connected in the front of the first main body portion 52 via a first linking portion 54 and a head portion 58 connected in the front of the first contact portion 55. The first terminal 51 is usually a slender component with an overall length of 10 mm, an overall width of 2 mm, and an overall height of 1.2 mm. Any of these dimensions can be changed if necessary.

The second terminal 151 is an integrated component created by stamping and bending a conductive metal sheet, and has a second main body portion 152, a second fixed portion 153 connected to the rear of the second main body portion 152, a second contact portion 155 formed in the second main body portion 152 and a second lock portion 156 connected in front of the second contact portion 155. The second fixed portion 153 has a core wire sealing portion 153*a* immobilizing and sealing the core wire 192 serving as the connecting portion to the electrical wire 191 and a sealing coat portion 153*b* is an insulating coating covering the core wire 192 and immobilizing and coating the electrical wire 191. The second fixed portion 153 is electrically and mechanically connected and secured to the core wire 192 of the electrical wire 191 and the second terminal 151 is mounted directly on the end of the electrical wire 191 without using a component such as a housing. The electrical wire 191 can be a power line, a ground line or a signal line.

The first fixed portion 53 is a flat plate with a rectangular profile which is electrically and mechanically connected and secured to a connection pad 92 formed on the surface of the board 91 using a connecting means such as solder. The bottom surface of the first fixed portion 53 is connected to the surface of the connection pad 92 using a connecting means such as solder so that the first terminal 51 is mounted directly on the board 91 without using a component such as a housing. The connection pad 92 is a flat metal component connected to the metal trace (not shown) of a power line, ground line or signal wire of the board 91.

The bottom surface of the first fixed portion 53 extends substantially parallel to the bottom surface of the first linking portion 54 and the first contact portion 55, and is positioned below the bottom surface of the first linking portion 54 and the first contact portion 55. In this way, when the lower surface of the first fixed portion 53 is connected to the surface of the connection pad 92, enough space to mate the first terminal 51 with the second terminal 151 is created between the lower surfaces of the first linking portion 54 and first contact portion 55 and the surface of the board 91.

The first contact portion 55 is an angular tube-shaped component with a rectangular cross-sectional profile, and includes a flat, rectangular upper panel portion 55*b* and a flat, rectangular lower panel portion 55*c* opposite the upper panel portion 55*b*. When the first terminal 51 is mated with the second terminal 151, it is inserted into the angular tube-shaped second contact portion 155 of the second terminal 151, where it comes into contact with the second contact portion 155 to establish an electrical connection between the first terminal 51 and the second terminal 151. In this situation, the first contact portion 55 is elastically clamped from above and below by the cantilevered second contact arm portions 155*a* of the second terminal 151. In this way, a reliable electrical connection can be maintained between the first terminal 51 and the second terminal 151. A slit-like gap 55*a* extending in the longitudinal direction of the first terminal 51 is unavoidably formed on the lower panel portion 55*c* of the first contact portion 55.

Figure 3A:
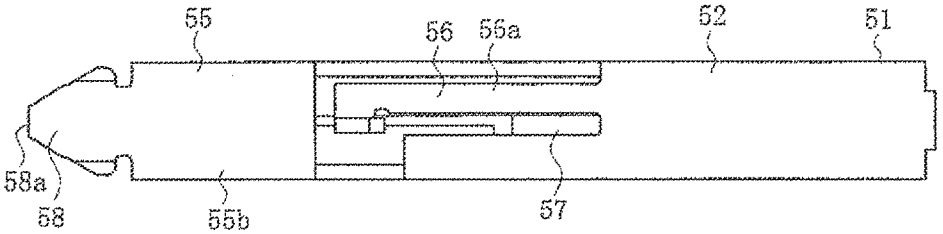
Figure 3B:
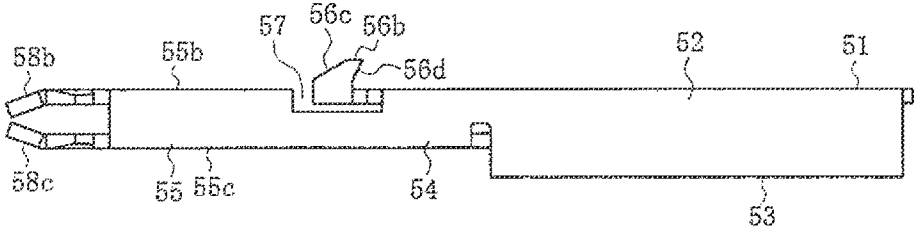
Figure 3C:
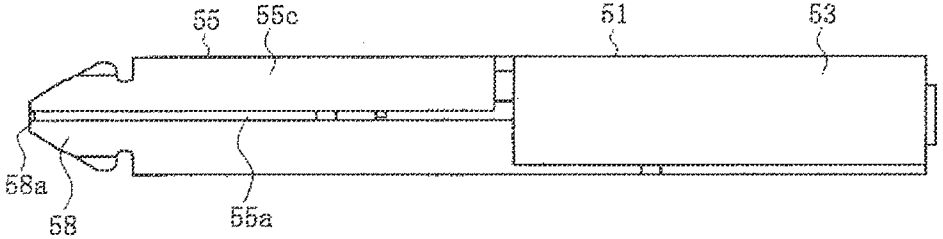
Figure 3D:
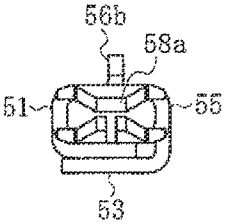

The head portion 58 is the portion which is inserted first into the opening 157 in the second terminal 151 when the first terminal 51 is inserted into the second terminal 151. As shown in FIGS. 3A and 3C, it has a funnel-shaped profile which becomes smaller in the width direction towards the front when viewed from above, and functions as a guide portion when inserted into the opening 157 of the second terminal 151. The head portion 58 includes an upper panel portion 58*b* connected to the upper panel portion 55*b* of the first contact portion 55 and a lower panel portion 58*c* connected to the lower panel portion 55*c* of the first contact portion 55. The upper panel portion 58*b* and the lower panel portion 58*c* are inclined so that at least the portions near the leading ends approach each other, and this enables a platform-shaped profile to be formed which becomes smaller in the width direction towards the front when viewed from the side.

The leading end portion 58*a* of the head portion 58 comes into contact with the inner wall portion 158 of the second terminal 151 when the first terminal 51 engages the second terminal 151, and this functions as a stopper portion stopping the advancement of the mating direction of the first terminal 51 (the forward direction). The leading end portion 58*a* functions as a positioning portion defining the relative positions of the first terminal 51 and the second terminal 151 in the mating direction.

The first terminal 51 includes a first lock portion 56 which keeps the first terminal 51 mated with the second terminal 151. The first lock portion 56 is arranged in the forward portion of the first main body portion 52 inside a first opening portion 57 formed on the upper surface of the first linking portion 54 to the rear of the first contact portion 55. In other words, the first lock portion 56 and the first contact portion 55 are arranged side by side with respect to the longitudinal direction, that is, the mating direction, of the first terminal 51. The first lock portion 56 includes a cantilevered lock arm portion 56*a* whose base end is integrally connected to the upper panel portion of the first main body portion 52 and which extends forward inside the first opening portion 57, and a lock piece 56*b* serving as a first engaging portion connected to the leading end of the lock arm portion 56*a*.

Figure 2:
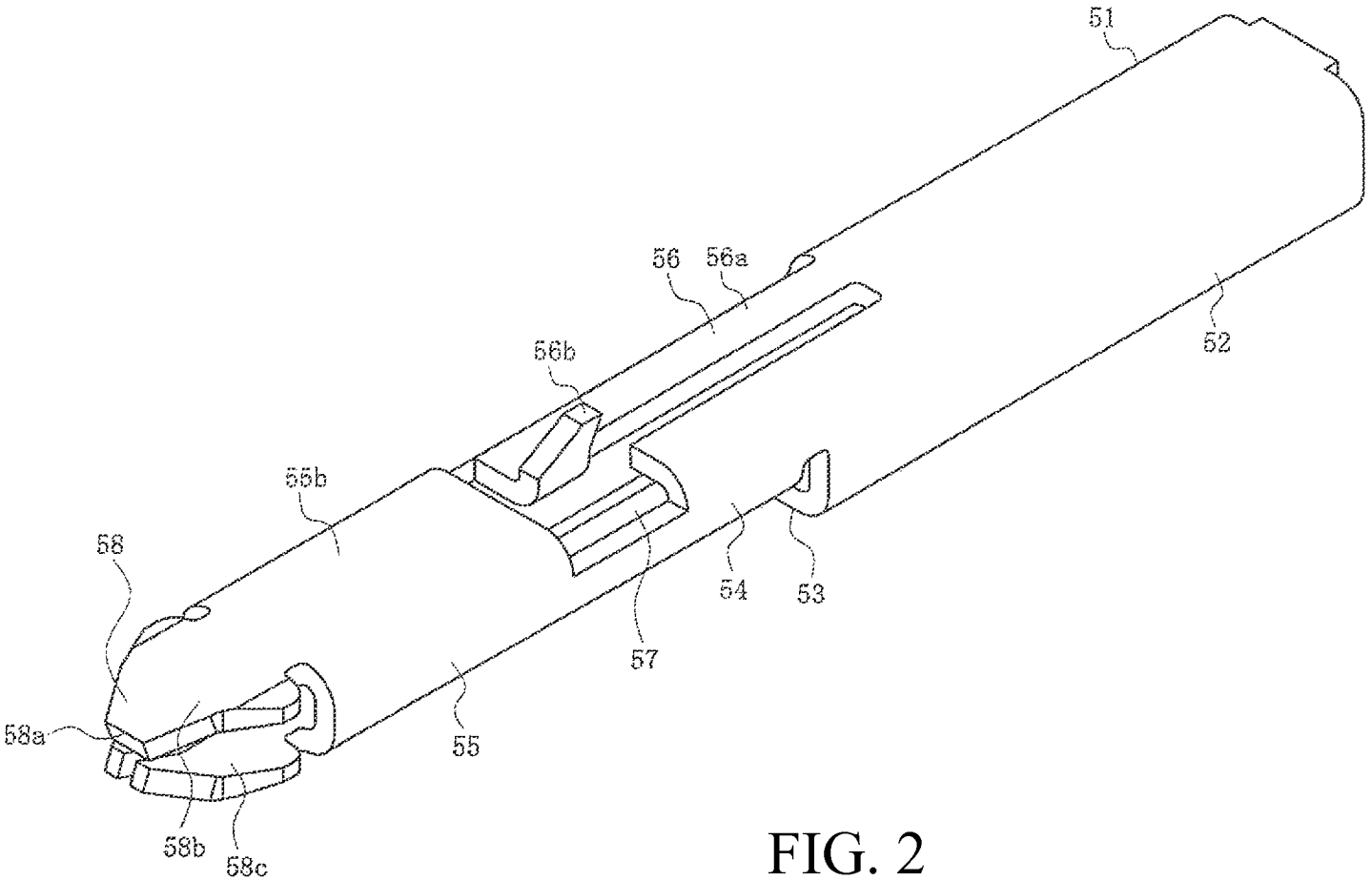
FIG. 2 is a perspective view of the first terminal of FIGS. 1A and 1B.
Figure 3E:
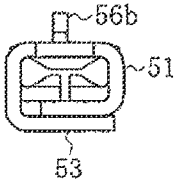

The lock arm portion 56*a* is a type of plate spring which is elastically deformable in the vertical direction at the free end; that is, the leading end. This elastically displaces the lock piece 56*b* in the vertical direction. In the initial position, that is, the free position, before the mating operation, as shown in FIGS. 2-3E, the upper surface of the lock arm portion 56*a* is substantially flush with the upper surface of the upper panel portion 55*b* of the first contact portion 55 and the upper surface of the first main body portion 52, and the lock piece 56*b* protrudes upward from the upper surface of the upper panel portion 55*b* of the first contact portion 55 and the upper surface of the first main body portion 52. Also, the front edge 56*c* of the lock piece 56*b* is an inclined edge inclining to the rear, and this smoothly displaces the lock piece 56*b* downward when the first terminal 51 is mated with the second terminal 151. The back edge 56*d* of the lock piece 56*b* is a substantially orthogonal edge inclined slightly to the rear, and this maintains reliable engagement with the lock opening 156*a* or second engaging portion of the second lock portion 156 of the second terminal 151 while the first terminal 51 is mated with the second terminal 151.

Figure 4:
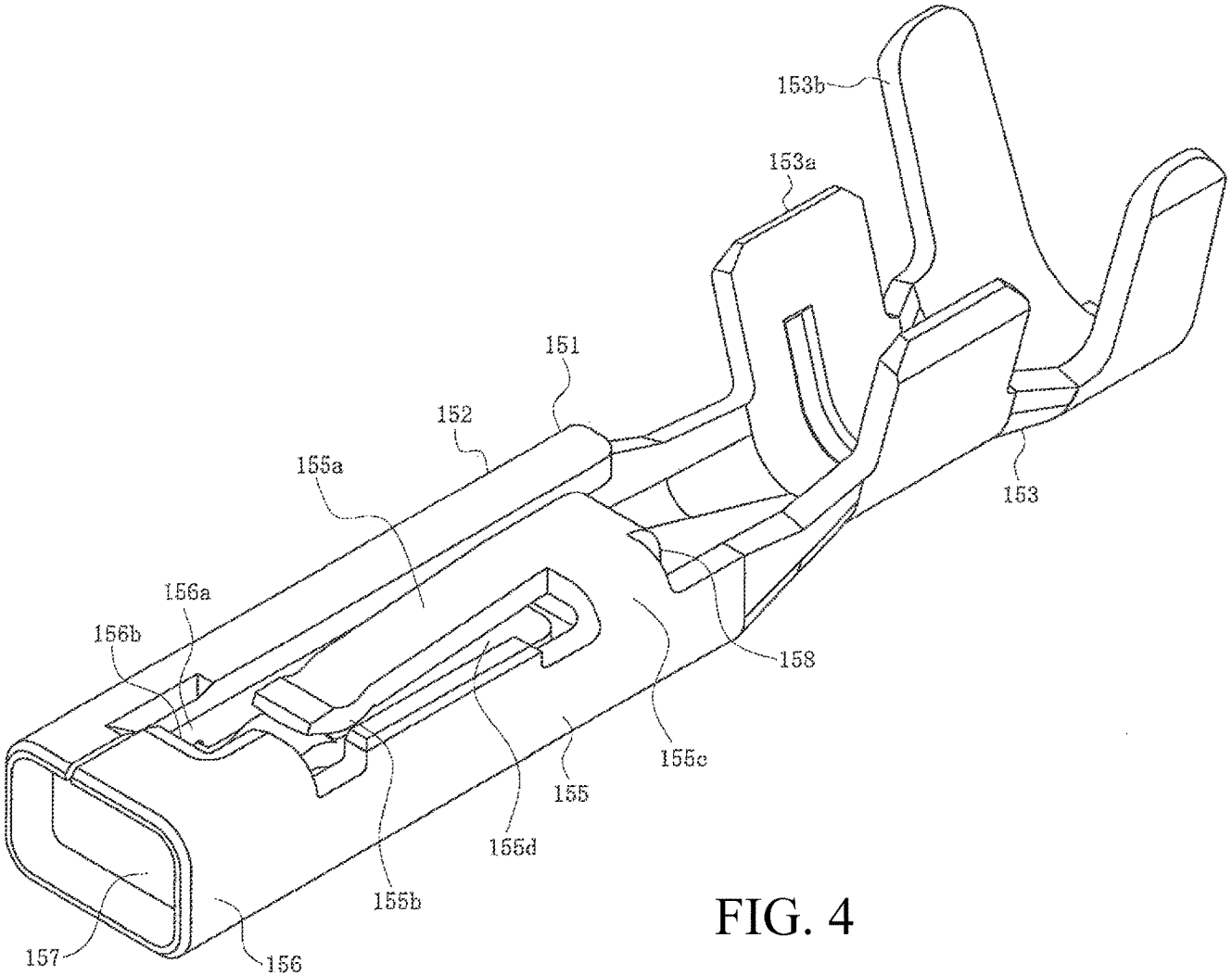
FIG. 4 is a perspective view of a second terminal according to the first embodiment of the Present Disclosure.
Figure 5A:
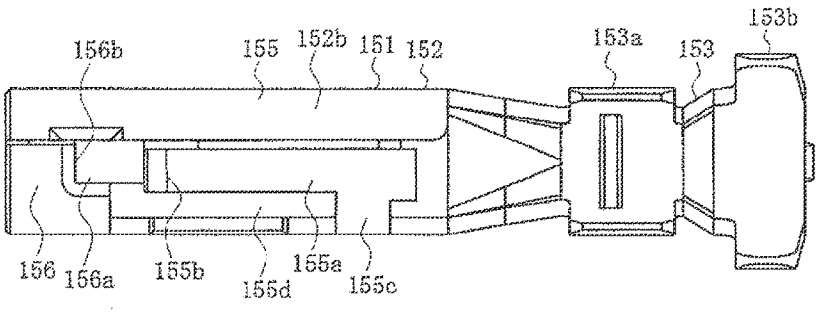
Figure 5B:
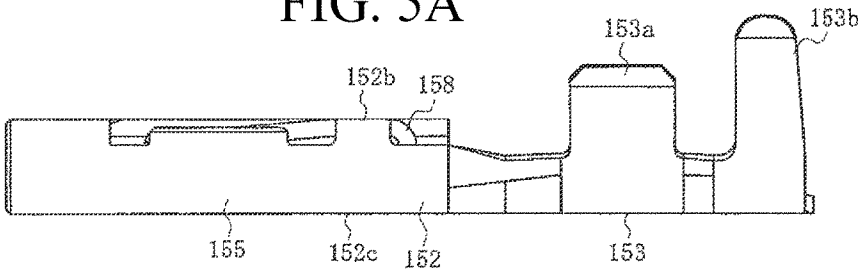
Figure 5C:
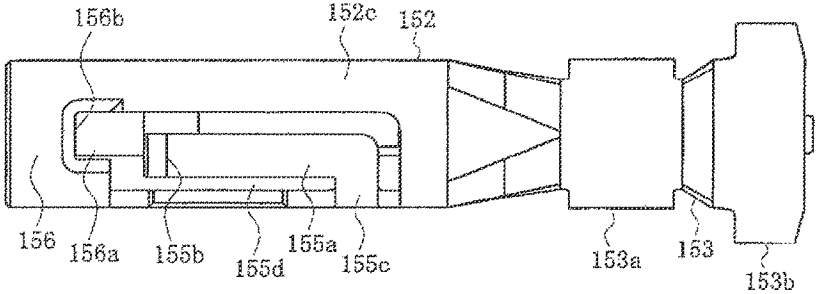
Figure 5E:
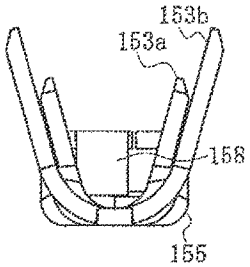

FIGS. 4-5E illustrate the configuration of the second terminal 151. As mentioned above, the second terminal 151 has a second main body portion 152, a second fixed portion 153, a second contact portion 155 and a second lock portion 156. The second fixed portion 153 includes a core wire sealing portion 153*a* and a sealing coat portion 153*b*. If necessary, solder may be applied to more firmly secure the connection between the core wire 192 and the core wire sealing portion 153*a*.

The second main body portion 152 is an angular tube-shaped component with a rectangular cross-sectional profile, and includes a flat, rectangular upper panel portion 152*b*, and a flat, rectangular lower panel portion 152*c* opposite the upper panel portion 152*b*. The second lock portion 156 and the second contact portion 155 are arranged side by side with respect to the longitudinal direction, that is, the mating direction, of the second terminal 151. There is an opening 157 with a rectangular profile formed inside the second main body portion 152 and opening in front of the second terminal 151.

The second contact portion 155 has a pair of cantilevered second contact arm portions 155*a* arranged, respectively, on the upper panel portion 152*b* and the lower panel portion 152*c* of the second main body portion 152, a pair of arm supporting portions 155*c* supporting the base end of each second contact arm portion 155*a* and a pair of contact protruding portions 155*b* formed near the leading end of each second contact arm portion 155*a*. A second opening 155*d* is formed in both the upper panel portion 152*b* and the lower panel portion 152*c* of the second main body portion 152. The second contact arm portions 155*a*, the arm supporting portions 155*c* and the contact protruding portions 155*b* are all arranged inside the corresponding second opening 155*d*.

The arm supporting portions 155*c* are integrally connected on one end to a side panel of the second main body portion 152, and integrally connected on the leading end to the base end of a second contact arm portion 155*a*. The second contact arm portions 155*a* are a type of plate spring extending forward in which the leading end, that is, the free end, is elastically deformable in the vertical direction, which elastically displaces the contact protruding portions 155*b* in the vertical direction.

In the initial position, that is, the free position, before the mating operation, as shown in FIGS. 4-5E, the leading ends of the second contact arm portions 155*a* are inclined towards the inner center line of the angular tube-shaped second main body portion 152. Therefore, the bottom surfaces of the contact protruding portions 155*b* of the second contact arm portions 155*a* arranged on the upper panel portion 152*b* of the second main body portion 152 are displaced downward from the bottom surface of the upper panel portion 152*b*, and the upper surfaces of the contact protruding portions 155*b* of the second contact arm portions 155*a* arranged on the lower panel portion 152*c* of the second main body portion 152 are positioned above the upper surfaces of the lower panel portions 152*c*. When the first terminal 51 is mated with the second terminal 151, the first contact portion 55 of the first terminal 51 inserted into the second contact portion 155 comes into contact with the contact protruding portions 155*b* from above and below, and the upper and lower contact protruding portions 155*b* are elastically displaced upwards and downwards, the second contact arm portions 155*a* are deformed, and the spring action generated by the second contact arm portions 155*a* presses the contact protruding portions 155*b* into the first contact portion 55.

Figure 5D:
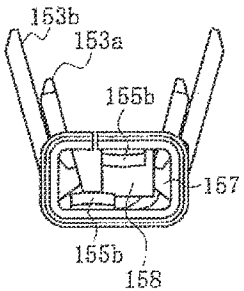

The second contact arm portions 155*a* may be positioned along the center line passing through the middle of the second main body portion 152 in the transverse direction, or may be positioned to the outside of the center line. In other words, the second contact arm portions 155*a* and the contact protruding portions 155*b* may be positioned along the center line of the second main body portion 152 in the transverse direction, or may be inclined to both the left and right of the center line. However, the contact protruding portion 155*b* on at least of the second contact arm portion 155*a* arranged on the upper panel portion 152*b* of the second main body portion 152 and the contact protruding portion 155*b* on at least of the second contact arm portion 155*a* arranged on the lower panel portion 152*c* of the second main body portion 152, as shown in FIG. 5D, preferably are arranged point-symmetrically with respect to the center point of the opening 157, that is, with respect to the center point of the rectangular cross-sectional profile of the second main body portion 152, when viewed from the mating direction.

The second lock portion 156 includes a pair of lock openings 156*a* formed on both opposing surfaces of the second main body portion 152, that is, on each of the upper panel portion 152*b* and lower panel portion 152*c* of the second main body portion 152. The leading edge portion of the lock opening 156*a* is an engaging edge portion 156*b* extending in the transverse direction of the second main body portion 152. When the first terminal 51 and the second terminal 151 are mated, the back edge 56*d* of the lock piece 56*b* of the first terminal 51 engages the engaging edge portion 156*b*, and this keeps the lock piece 56*b* and the lock opening 156*a* securely engaged.

If the position of the lock opening 156*a* with respect to the transverse direction of the second main body portion 152 is the position corresponding to the lock piece 56*b* of the first terminal 51 when mated with the second terminal 151, this position may be on the center line of the second main body portion 152 in the transverse direction or inclined to the left and right of the center line. However, the lock opening 156*a* formed on the upper panel portion 152*b* of the second main body portion 152 and the lock opening 156*a* arranged on the lower panel portion 152*c* of the second main body portion 152, when viewed from the mating direction, are preferably point-symmetrical with respect to the center point of the opening 157, that is, with respect to the center point of the rectangular cross-sectional profile of the second main body portion 152.

In the example shown in the Figures, the rear end of the second contact arm portion 155*a* arranged on the upper panel portion 152*b* of the second main body portion 152, which is one of the pair of second contact arm portions 155*a*, is integrally connected to the inner wall portion 158 serving as the stopper portion. The inner wall portion 158 is bent substantially orthogonal to the rear end of the second contact arm portion 155*a* and extends downward. The lower end preferably extends below the center line of the second main body portion 152 in the vertical direction. When the first terminal 51 is being mated with the second terminal 151, the inner wall portion 158 makes contact with the leading end portion 58*a* of the head portion 58 of the first terminal 151 and functions as a stopper portion stopping the advance of the first terminal 51 in the mating direction. The inner wall portion 158 functions as a positioning portion defining the relative positions of the first terminal 51 and the second terminal 151 in the mating direction.

Figure 6:
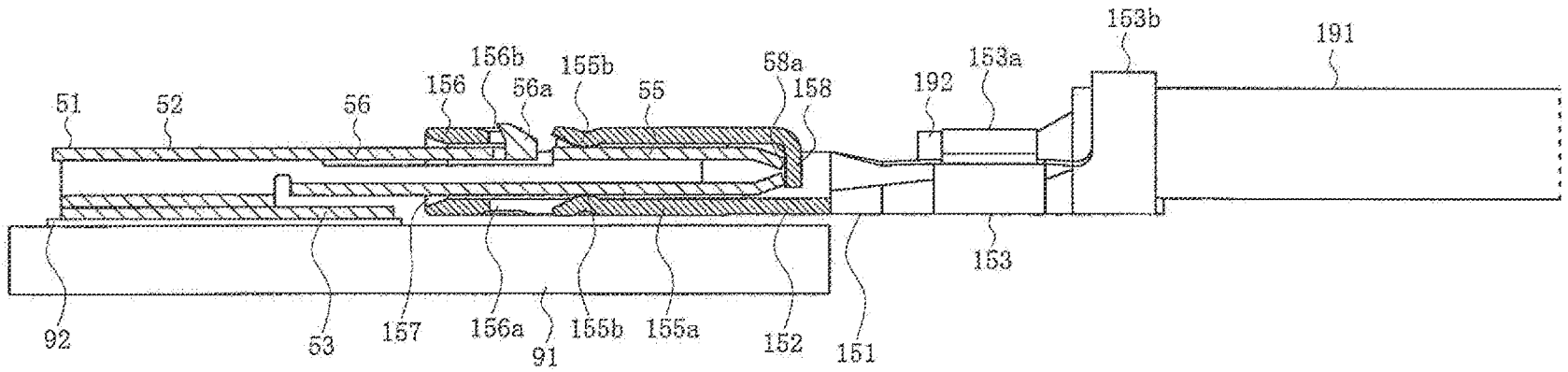
FIG. 6 is a simplified cross-sectional view of the first terminal and the second terminal engaging each other.
Figure 7A:
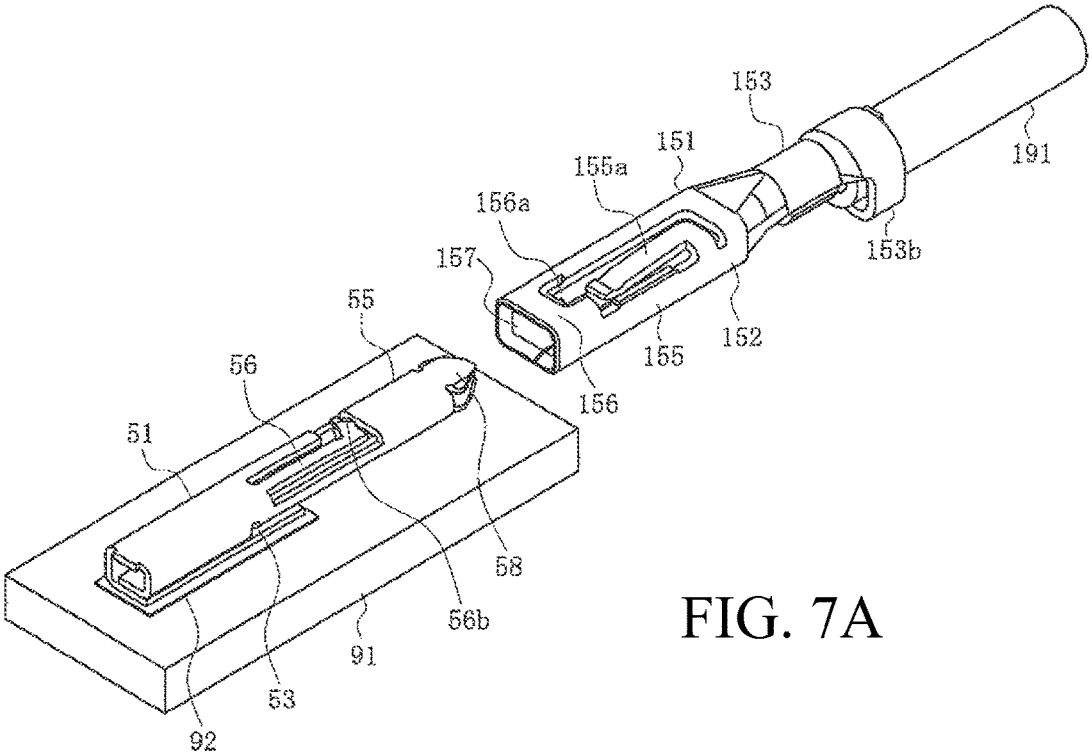
Figure 7B:
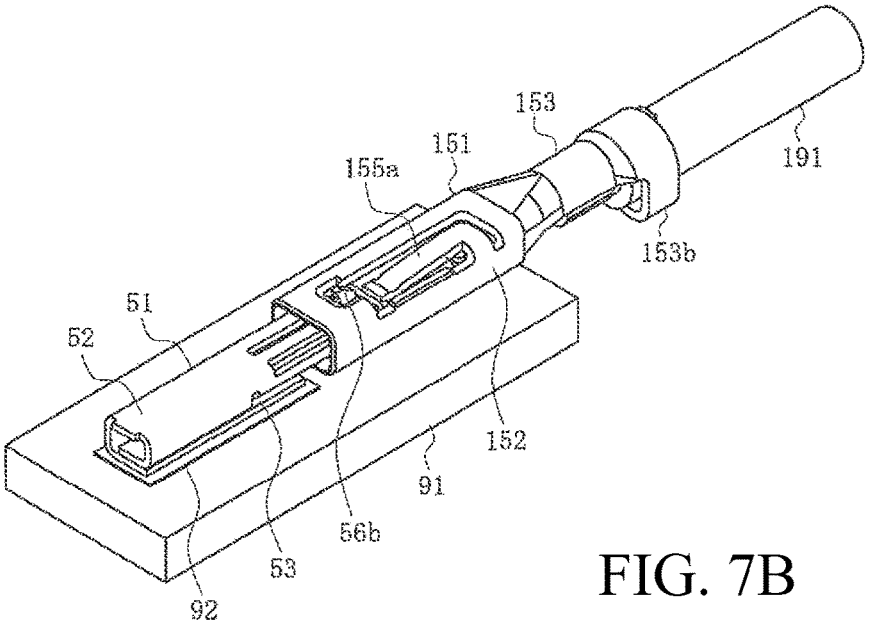

FIGS. 6-7B illustrate the operations performed to mate the first terminal 51 and the second terminal 151. Before the mating operation, the first fixed portion 53 is connected securely to the surface of a connection pad 92 using solder to mount the first terminal 51 on a board 91, and the core wire sealing portion 153*a* of the second fixed portion 153 is securely sealed to the core wire 192 of an electrical wire 191, and the sealing coat portion 153*b* is securely sealed to the insulating coating surrounding the core wire 192 to mount the second terminal 151 to an electrical wire 191.

Next, as shown in FIG. 1A, the operator aligns the leading end of the first terminal 51 with the leading end of the second terminal 151, moves the first terminal 51 and/or the second terminal 151 towards the opposing terminal, and inserts the first main body portion 52 of the first terminal 51 into the opening 157 in the second terminal 151. Because the head portion 58 of the terminal inserted into the opening 157 has a profile in which the width becomes gradually smaller in the direction of the leading end, the first main body 52 of the first terminal 51 can be smoothly inserted into the opening 157 in the second terminal 151.

As mentioned above, when the bottom surface of the first fixed portion 53 of the first terminal 51 is connected to the surface of a connection pad 92, there is space between the surface of the board 91 and lower surfaces of the first interconnecting portion 54 and the first contact portion 55. As a result, the first main body portion 52 can be inserted into the opening 157 in the second terminal 151 even though the first terminal 51 is mounted on the board 91.

When the first terminal 51 advances relative to the second terminal 151 in the mating direction, the lock piece 56*b* protruding upward comes into contact with the inner surface of the opening 157. However, because the front edge 56*c* of the lock piece 56*b* is an inclined edge that is inclined towards the rear, the lock piece 56*b* is smoothly displaced downward.

Once the first terminal 51 has advanced relative to the second terminal 151 in the mating direction and become mated, the leading end portion 58a of the head portion 58, as shown in FIG. 6, comes into contact with the inner wall portion 158 of the second terminal 151, and the relative advance of the first terminal 51 is stopped. Because contact between the leading end portion 58*a* and the inner wall portion 158 positions the first terminal 51 and the second terminal 151 relative to each other in the mating direction, and allows the lock piece 56*b* to reach the position of the lock opening 156a formed in the second lock portion 156 of the second terminal 151, the lock arm portions 56*a* are displaced upwards by the spring action and engage the lock opening 156*a*. This locks the first terminal 51 and the second terminal 151 in the mated position, and prevents any inadvertent unmating of the terminals. Because the back edge 56*d* of the lock piece 56*b* is an orthogonal edge extending vertically or a substantially orthogonal edge inclined slightly to the rear, it engages the engaging edge portion 156*b* of the lock opening 156*a*. As a result, the first terminal 51 and the second terminal 151 do not become unlocked and unmated even when significant force is applied in the unmating direction, which is the direction opposite the mating direction.

When the mating of the first terminal 51 and the second terminal 151 is complete, the first contact portion 55 of the first terminal 51 inserted into the second contact portions 155 of the second terminal 151 is clamped from above and below by the cantilevered second contact arm portions 155*a* of the second terminal 151. More specifically, the spring action of the upper and lower second contact arm portions 155*a* causes the contact protruding portions 155*b* formed near the leading ends of the second contact arm portions 155*a* to apply pressure to the first contact portion 55. In this way, the reliable contact is maintained between the first contact portion 55 and the second contact portions 155, and a reliable electrical connection is maintained between the first terminal 51 and the second terminal 151. Therefore, a reliable electrical connection is maintained between the electrical wire 191 and the conductive trace for the electrical wire 191 on the board 191 via the first terminal 51 and the second terminal 151.

As mentioned above, the first terminal 51 is a slender component, and the second terminal 151 mated with the first terminal 51 is also a slender component. Therefore, the operator has difficulty visually confirming whether or not the first terminal 51 has advanced far enough relative to the second terminal 151 in the mating direction during a mating operation performed on the first terminal 51 and the second terminal 151. However, in the Present Disclosure, when the mating operation between the first terminal 51 and the second terminal 151 has been completed, the leading end portion 58*a* of the head portion 58 of the first terminal 51 comes into contact with the inner wall portion 158 of the second terminal 151 and the relative advancement of the first terminal 51 is stopped. The operator knows that the mating operation has been completed when the impact of the advancing first terminal 51 being stopped is felt by the fingers. Also, when the mating operation for the first terminal 51 and the second terminal 151 has been completed, the spring action of the lock arm portion 56*a* returns the lock piece 56*b* to its original position and the lock opening 156*a* is engaged. The impact of this operation is also felt by the fingers, and the operator can reliably confirm that the operation has been completed.

Because a second contact arm portion 155*a* and a lock opening 156*a* of the second terminal 151 are arranged on both the upper panel portion 152*b* and the lower panel portion 152*c* of the second main body portion 152, the first terminal 51 and the second terminal 151 can be mated with each other even when the orientation of the second terminal 151 is inverted vertically with respect to the first terminal 51; that is, when the terminal is flipped over. However, because the first terminal 51 is a slender component, and the second terminal 151 mated with the first terminal 51 is also a slender component, the operator has difficulty visually confirming whether or not the second terminal 151 has been flipped over relative to the first terminal 51. However, because the first terminal 51 and the second terminal 151 can be mated with each other whether or not the second terminal 151 has been flipped over relative to the first terminal 51, the operator can still complete the mating operation easily and in a short period of time. Also, because the second contact portions 155 including the second contact arm portions 155*a* and the second lock portions 156 including the lock openings 156*a* are arranged side by side or in tandem in the mating direction and the first contact portion 55 and the first lock portion 56 of the first terminal 51 are arranged side by side or in tandem in the mating direction, the relative positions of the first contact portion 55, the first lock portion 56, the second contact portions 155, and the second lock portions 156 do not change, and contact between the first contact portion 55 and the second contact portions 155, and the locking operation of the first lock portion 56 and the second lock portions 156 remain unchanged whether or not the second terminal 151 has been flipped over relative to the first terminal 51.

In the example shown in the Figures, the second contact arm portion 155*a* arranged on the upper panel portion 152*b* and lower panel portion 152*c* of the second main body portion 152 are positioned so as to be point-symmetrical with respect to the center point of the opening 157 when viewed from the front, and the lock openings 156*a* arranged on the upper panel portion 152*b* and lower panel portion 152*c* of the second main body portion 152 are positioned so as to be point-symmetrical with respect to the center point of the opening 157. Therefore, the relative positions of the first contact portion 55, the lock piece 56*b* of the first lock portion 56, the second contact arm portion 155*a*, and the lock opening 156*a* do not change, and contact between the first contact portion 55 and the second contact arm portions 155*a*, and the locking operations of the lock piece 56*b* and the lock opening 156*a* remain unchanged whether or not the second terminal 151 has been flipped over relative to the first terminal 51.

In the present embodiment, the metal terminals are a first terminal 51 made of a conductive metal, and a second terminal 151 made of a conductive metal and mated with the first terminal 51. The first terminal 51 includes a first main body portion 52, a first fixed portion 53 fixed to a connection pad 92 of a board 91, a first contact portion 55 and a first lock portion 56. The second terminal 151 includes a second main body portion 152, a second fixed portion 153 fixed to the core wire 192 of an electrical wire 191, a second contact portion 155 contacting the first contact portion 55 and a second lock portion 156 locking the first lock portion 56. The first lock portion 56 includes a lock piece 56*b* arranged on one surface of the first main body portion 52, and the second lock portion 156 includes a pair of lock openings 156*a* arranged on both opposing surfaces of the second main body portion 152.

In this way, the first terminal 51 and the second terminal 151 can be mated and the first lock portion 56 and the second lock portion 156 can be locked even when the orientation of one or the other of the first terminal 51 and the second terminal 151 has been inverted. Therefore, the mating operations for the first terminal 51 and the second terminal 151 can be performed easily and in a short period of time. As a result, a board 91 and an electrical wire 191 can be connected easily and in a short period of time. The first fixed portion 53 is fixed to a connection pad 92 on a board 91, and the second fixed portion 153 is fixed to the core wire 192 of an electrical wire 191. As a result, the first terminal 51 and the second terminal 151 can be mounted directly on a board 91 and an electrical wire 191, thereby reducing the amount of mounting space required. Also, the structure of the first terminal 51 and the second terminal 151 can be simplified, costs reduced, and the number of applications for metal terminals increased.

Also, the first contact portion 55 and the first lock portion 56 are arranged side by side in the mating direction, and the second contact arm portions 155 and the second lock portion 156 are arranged side by side in the mating direction. As a result, the first contact portion 55 and the second contact portions 155 can make contact with each other, and the first lock portion 56 and the second lock portions 156 can become locked even when the orientation of one or the other of the first terminal 51 and the second terminal 151 has been inverted.

The lock openings 156*a* are also arranged at point-symmetrical positions when viewed in the mating direction. As a result, the lock piece 56*b* can reliably engage a lock opening 156*a*, and the first lock portion 56 and the second lock portion 156 can become locked even when the vertical orientation of the second terminal 151 has been flipped relative to the first terminal 51.

A second contact portion 155 is arranged on both opposing surfaces of the second main body portion 152, and includes a pair of second contact arm portions 155*a* for elastically clamping the first contact portion 55. As a result, reliable contact can be established between the first contact portion 55 and the second contact portion 155 even when the vertical orientation of the second terminal 151 has been inverted relative to the first terminal 51.

FIGS. 8A-11 illustrate a second embodiment of the Present Disclosure. All components identical to those in the first embodiment are denoted by the same reference numbers and further explanation of these components has been omitted. Explanation of all operations and effects similar to those of the first embodiment has also been omitted.

In the first embodiment, the metal terminals were connected to a board 91 and an electrical wire 191. In the present embodiment, the metal terminals are connected to a board 91 and another board 195. Here, the first terminal 51 is mounted directly on a board 91, as in the first embodiment, and the second terminal 151 is mounted directly on a board 195.

In the present embodiment, the second terminal 151 includes a second linking portion 154 connected to the rear of the second main body portion 152, and the second fixed portion 153 is connected below the second linking portion 154. In other words, the second fixed portion 153 is connected to the rear of the second main body portion 152 via the second linking portion 154. In the present embodiment the second fixed portion 153 differs from the second fixed portion 152 in the first embodiment in that it is flat and rectangular and has neither a core wire sealing portion 153*a* nor a sealing coat portion 153*b*. This component is connected both electrically and mechanically to the connection pad 196 on the surface of the board 195 using a connecting means such as solder. At least the bottom surface of the second fixed portion 153 is preferably flat. By connecting the bottom surface of the second fixing portion 153 to the surface of the connection pad 196 using solder, the second terminal 151 can be mounted directly on the board 195 without using a component such as a housing. The connection pad 196 is a flat metal component connected to a conductive trace (not shown) on the board 195 for a power line, ground wire or signal line.

Because the rest of the configuration of the second terminal 151 in the present embodiment is identical to that of the first embodiment, further explanation of the configuration has been omitted. Because the configuration of the first terminal 51 in the present embodiment is identical to that of the first embodiment, explanation of this terminal has been omitted. Because the mating operation of the first terminal 51 and the second terminal 151 in the present embodiment is identical to that of the first embodiment, further explanation of the operation has been omitted.

In the present embodiment, the second terminal 151 is mounted on a board 195. When the first terminal 51 and the second terminal 151 are engaged, a conductive trace on the board 91 is connected electrically to a conductive trace on the other board 195 via the first terminal 51 and the second terminal 151.

Figure 8A:
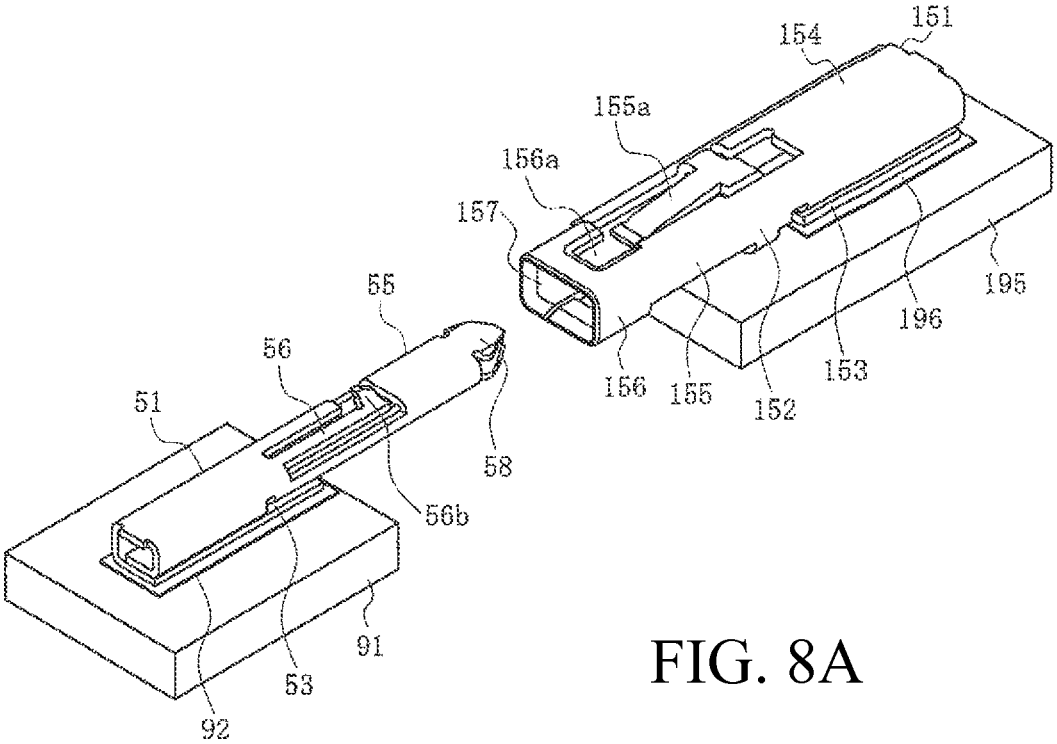
FIG. 8A is the view before engagement and FIG. 8B is the view after engagement.
Figure 8B:
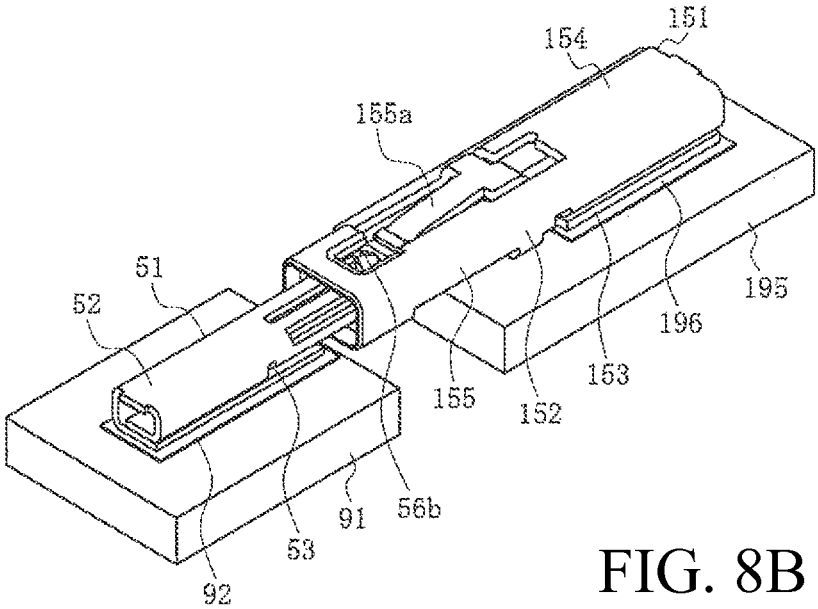
Figure 9:
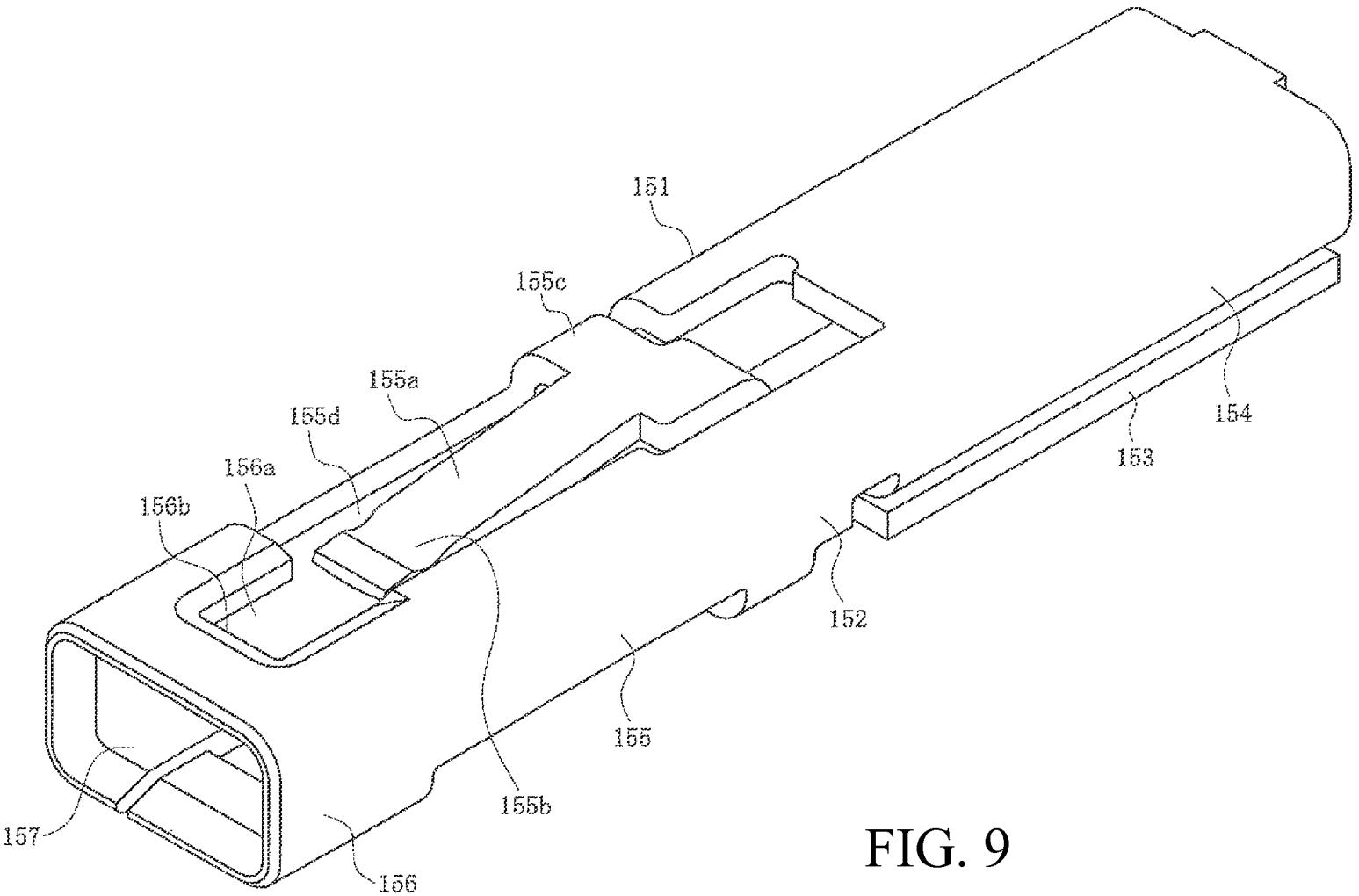
FIG. 9 is a perspective view of the second terminal of FIGS. 8A and 8B.
Figure 10A:
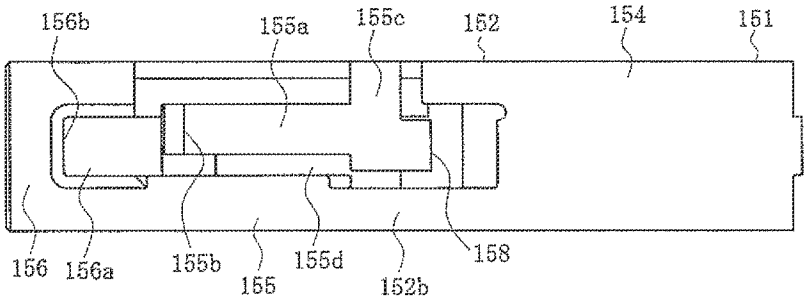
Figure 10B:
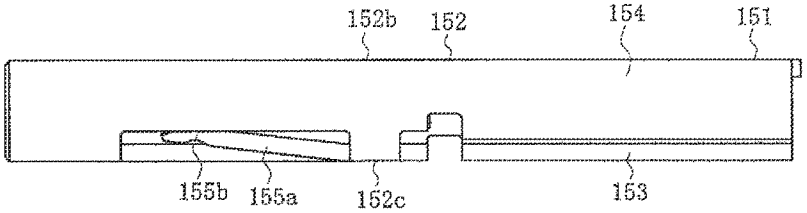
Figure 10C:
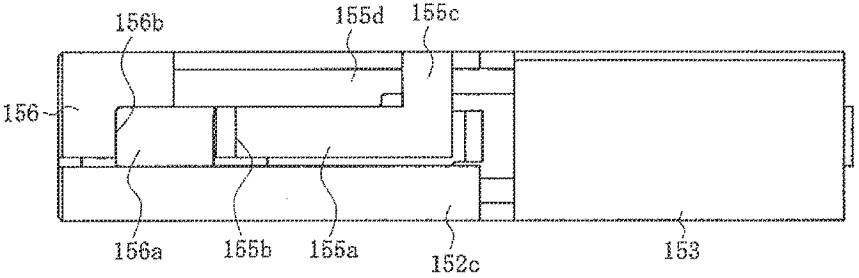
Figure 10D:
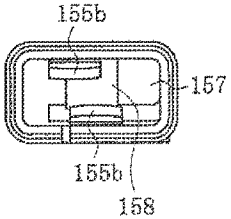
Figure 10E:
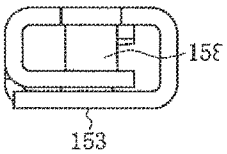
Figure 11:
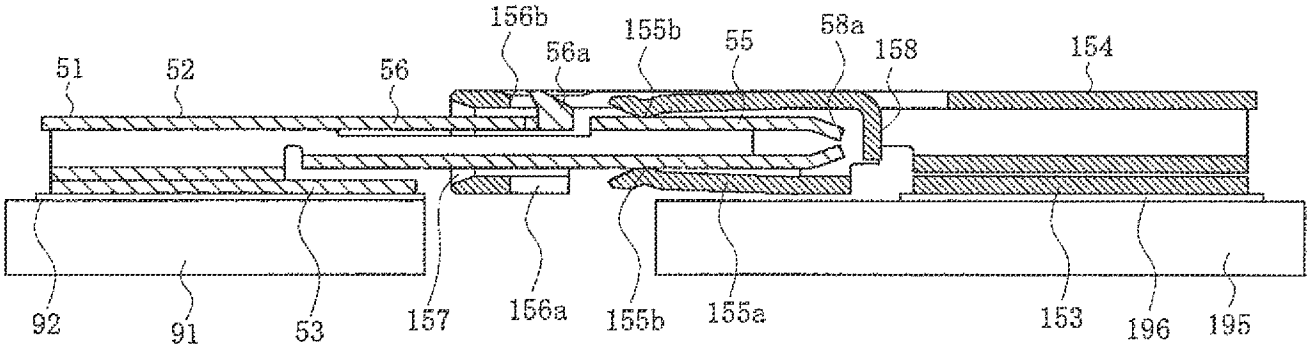
FIG. 11 is a simplified cross-sectional view of the first terminal and the second terminal engaging each other.
Figure 12B:
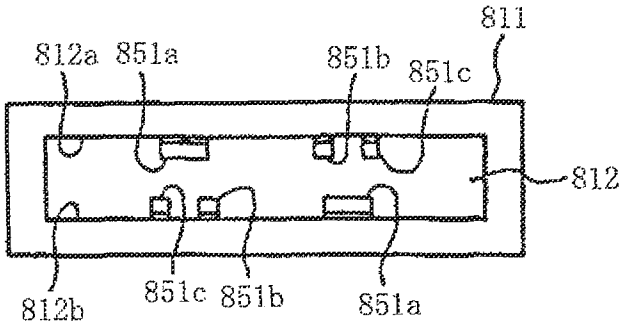
FIG. 12B Prior Art
Figure 12A:
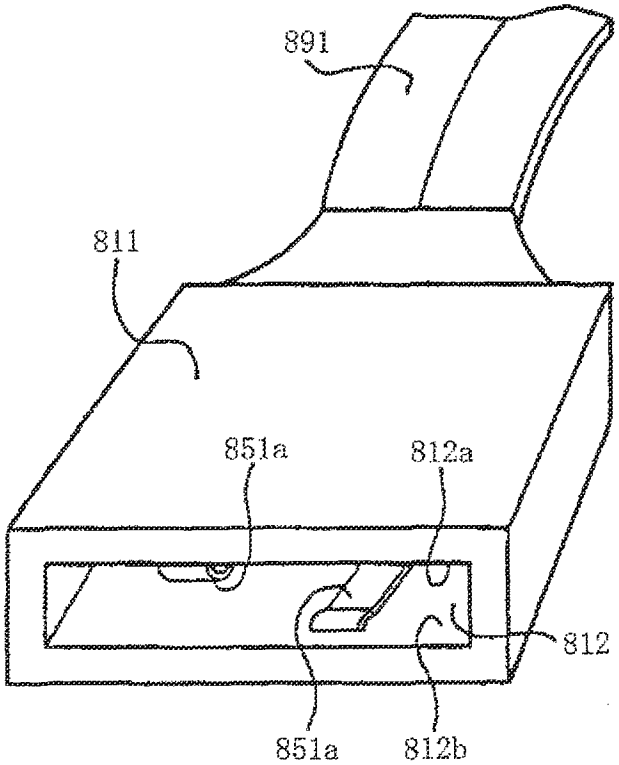
FIG. 12A Prior Art

In the present embodiment, as in the first embodiment, the first terminal 51 and the second terminal 151 can engage each other even when the vertical orientation of the second terminal 151 has been inverted relative to the first terminal 51. Therefore, if necessary, the vertical orientation of the other board 195 relative to the one board 91 can be inverted as shown in FIGS. 8A and 8B, and the one board 91 and the other board 195 can still be connected.

In the present embodiment, the first fixed portion 53 is connected electrically and mechanically to a connection pad on the one board 91, the first terminal 51 is mounted directly on the board 91, the second fixed portion 1153 is connected electrically and mechanically to a connection pad of the other board 196, and the second terminal 151 is mounted directly on the board 195. As a result, the one board 91 and the other board 195 can be connected.

In the first and second embodiments, the first terminal 51 is mounted on a board 91. However, the first terminal 51 can be mounted on an electrical wire 191 like the second terminal 151 by changing the first fixed portion 53 to one resembling the second fixed portion 153. Therefore, the first terminal 51 and the second terminal 151 can be used to connect an electrical wire to another electrical wire, or to connect a board to another board.

While a preferred embodiment of the Present Disclosure is shown and described, it is envisioned that those skilled in the art may devise various modifications without departing from the spirit and scope of the foregoing Description and the appended Claims.

What is claimed is:

1. Metal terminals, the metal terminals comprising:

a first terminal made of a conductive metal, the first terminal having a first main body portion, a first fixed portion, a first contact portion, and a first lock portion, the first fixed portion configured to be fixed to a connecting portion of a first conductive component, the first lock portion including a first engaging portion arranged on a surface of the first main body portion; and a second terminal made of a conductive metal, the second terminal having a second main body portion, a second fixed portion, a second contact portion, and a second lock portion, the second fixed portion configured to be fixed to a connecting portion of a second conductive component, the second lock portion including a pair of second engaging portions arranged on opposing surfaces of the second main body portion, wherein the second terminal is configured to be mated to the first terminal in first and second manners, wherein in the first manner, the second contact portion contacts the first contact portion and the first lock portion engages a first one of the pair of second engaging portions, and wherein in the second manner, the second contact portion contacts the first contact portion and the first lock portion engages a second one of the pair of second engaging portions.

2. The metal terminals of claim 1, wherein the second engaging portions are each arranged at point symmetrical positions when viewed from a mating direction.

3. The metal terminals of claim 1, wherein the second contact portion includes a pair of second contact arm portions arranged on opposing surfaces of the second main body portion so as to elastically clamp the first contact portion.

4. The metal terminals of claim 3, wherein the second contact arm portions are each arranged at point symmetrical positions when viewed from the mating direction.

5. The metal terminals of claim 1, wherein the first fixed portion is configured to be connected electrically and mechanically to the connecting portion of the first conductive component, the first terminal is configured to be mounted directly on the first conductive component, the second fixed portion is configured to be connected electrically and mechanically to the connecting portion of the second conductive component, and the second terminal is configured to be mounted directly on the second conductive component.

6. The metal terminals of claim 1, wherein the first conductive component is a board or an electrical wire, and the second conductive component is a board or an electrical wire.

7. The metal terminals of claim 1, wherein the first contact portion is positioned forward of the first lock portion in a mating direction, and the second contact portion is positioned forward of the second lock portion in the mating direction.

8. The metal terminals of claim 7, wherein the first fixed portion is configured to be connected electrically and mechanically to the connecting portion of the first conductive component, the first terminal is configured to be mounted directly on the first conductive component, the second fixed portion is configured to be connected electrically and mechanically to the connecting portion of the second conductive component, and the second terminal is configured to be mounted directly on the second conductive component.

9. The metal terminals of claim 7, wherein the first conductive component is a board or an electrical wire, and the second conductive component is a board or an electrical wire.

10. The metal terminals of claim 7, wherein the second engaging portions are each arranged at point symmetrical positions when viewed from the mating direction.

11. The metal terminals of claim 10, wherein the first fixed portion is configured to be connected electrically and mechanically to the connecting portion of the first conductive component, the first terminal is configured to be mounted directly on the first conductive component, the second fixed portion is configured to be connected electrically and mechanically to the connecting portion of the second conductive component, and the second terminal is configured to be mounted directly on the second conductive component.

12. The metal terminals of claim 10, wherein the first conductive component is a board or an electrical wire, and the second conductive component is a board or an electrical wire.

13. The metal terminals of claim 10, wherein the second contact portion includes a pair of second contact arm portions arranged on opposing surfaces of the second main body portion so as to elastically clamp the first contact portion.

14. The metal terminals of claim 13, wherein the second contact arm portions are each arranged at point symmetrical positions when viewed from the mating direction.

15. The metal terminals of claim 14, wherein the first fixed portion is configured to be connected electrically and mechanically to the connecting portion of the first conductive component, the first terminal is configured to be mounted directly on the first conductive component, the second fixed portion is configured to be connected electrically and mechanically to the connecting portion of the second conductive component, and the second terminal is configured to be mounted directly on the second conductive component.

16. The metal terminals of claim 15, wherein the first conductive component is a board or an electrical wire, and the second conductive component is a board or an electrical wire.

17. The metal terminals of claim 7, wherein the second contact portion includes a pair of second contact arm portions arranged on opposing surfaces of the second main body portion so as to elastically clamp the first contact portion.

18. The metal terminals of claim 17, wherein the second contact arm portions are each arranged at point symmetrical positions when viewed from the mating direction.

19. The metal terminals of claim 18, wherein the first fixed portion is configured to be connected electrically and mechanically to the connecting portion of the first conductive component, the first terminal is configured to be mounted directly on the first conductive component, the second fixed portion is configured to be connected electrically and mechanically to the connecting portion of the second conductive component, and the second terminal is configured to be mounted directly on the second conductive component.

20. The metal terminals of claim 19, wherein the first conductive component is a board or an electrical wire, and the second conductive component is a board or an electrical wire.

* * * * *